US009646560B2

(12) United States Patent
Kim et al.

(10) Patent No.: US 9,646,560 B2
(45) Date of Patent: May 9, 2017

(54) LIQUID CRYSTAL DISPLAY DEVICE FOR IMPROVING CROSSTALK CHARACTERISTICS

(71) Applicant: SAMSUNG ELECTRONICS CO., LTD., Suwon-si, Gyeonggi-Do (KR)

(72) Inventors: Jin-Woo Kim, Chanwon-si (KR); Chang-Sig Kang, Hwaseong-si (KR); Yong-Joo Kim, Chungju-si (KR); Chang-Sin Kim, Suwon-si (KR); Jin-Woo Lee, Yongin-si (KR)

(73) Assignee: SAMSUNG ELECTRONICS CO., LTD., Suwon-si, Gyeonggi-Do (KR)

( * ) Notice: Subject to any disclaimer, the term of this patent is extended or adjusted under 35 U.S.C. 154(b) by 69 days.

(21) Appl. No.: 14/614,469

(22) Filed: Feb. 5, 2015

(65) Prior Publication Data

US 2015/0356932 A1 Dec. 10, 2015

(30) Foreign Application Priority Data

Jun. 10, 2014 (KR) ..... 10-2014-0070358

(51) Int. Cl.
*G09G 3/36* (2006.01)

(52) U.S. Cl.
CPC ..... *G09G 3/3688* (2013.01); *G09G 2310/027* (2013.01); *G09G 2320/0285* (2013.01)

(58) Field of Classification Search
CPC ..... G09G 3/3607; G09G 2320/0285; G09G 2310/027; G09G 3/3688
See application file for complete search history.

(56) References Cited

U.S. PATENT DOCUMENTS

| | | | | |
|---|---|---|---|---|
| 5,670,973 | A * | 9/1997 | Bassetti, Jr. | G09G 3/2011 345/100 |
| 6,879,310 | B2 * | 4/2005 | Nose | G09G 3/3607 345/88 |
| 8,896,639 | B2 * | 11/2014 | Yamazaki | 257/288 |
| 2007/0080927 | A1 | 4/2007 | Zhou et al. | |
| 2007/0139337 | A1 | 6/2007 | Yeh et al. | |
| 2008/0211755 | A1 * | 9/2008 | Song | G09G 3/2011 345/87 |

FOREIGN PATENT DOCUMENTS

| | | |
|---|---|---|
| JP | 2007-025239 | 1/2007 |
| KR | 1020060116587 | 11/2006 |
| KR | 1020060129191 | 12/2006 |
| KR | 1020130073779 | 7/2013 |
| WO | 2005050607 | 6/2005 |

* cited by examiner

*Primary Examiner* — Abbas Abdulselam
(74) *Attorney, Agent, or Firm* — F. Chau & Associates, LLC

(57) ABSTRACT

A liquid crystal display (LCD) device includes a display including a plurality of pixels, a voltage compensation controller configured to control the plurality of pixels and determine whether to compensate a predetermined grayscale voltage to be applied to the plurality of pixels, and a voltage generator configured to provide the predetermined grayscale voltage to the plurality of pixels in response to the voltage compensation controller determining not to compensate the predetermined grayscale voltage, and to compensate the predetermined grayscale voltage and provide the compensated predetermined grayscale voltage to the plurality of pixels in response to the voltage compensation controller determining to compensate the predetermined grayscale voltage.

19 Claims, 10 Drawing Sheets

114

| |
|---|
| Δv1, Δt1 |
| Δv2, Δt2 |
| Δv3, Δt3 |
| Δv4, Δt4 |
| ⋮ |

120

LIQUID CRYSTAL DISPLAY DEVICE FOR IMPROVING CROSSTALK CHARACTERISTICS

CROSS-REFERENCE TO RELATED APPLICATIONS

This application claims priority under 35 U.S.C. §119 to Korean Patent Application No. 10-2014-0070358, filed on Jun. 10, 2014, the disclosure of which is hereby incorporated by reference in its entirety.

TECHNICAL FIELD

Exemplary embodiments of the present inventive concept relate to a liquid crystal display (LCD) device, and more particularly, to an LCD device capable of reducing a crosstalk phenomenon.

DISCUSSION OF THE RELATED ART

In recent years, various types of flat panel display devices have been developed and used in a variety of electronic devices. Among such flat panel display devices is a liquid crystal display (LCD) device.

An LCD may display a desired image by controlling the transmittance of light that passes through a liquid crystal layer according to an image signal applied to control switches (e.g., an array of thin film transistors (TFTs)) arranged in a matrix formation.

When an LCD displays certain patterns, an instantaneous load change may occur, which may cause signal interference between pixels and a distortion of a common voltage, which can result in the occurrence of a crosstalk phenomenon.

SUMMARY

According to an exemplary embodiment of the inventive concept, an LCD includes a display, a voltage compensation controller and a voltage generator. The display includes a plurality of pixels. The voltage compensation controller is configured to control the pixels and determine whether to compensate a predetermined voltage that is to be applied to the pixels. The voltage generator is configured to, when a grayscale voltage is supplied to the pixels, selectively supply a grayscale voltage that is compensated under control of the voltage compensation controller.

In an exemplary embodiment, the voltage compensation controller may receive an image data signal from an external source and compare the image data signal with a specific data pattern to determine whether to compensate the grayscale voltage, and provides information relating to the result of the determination.

In an exemplary embodiment, the voltage compensation controller may include a timing controller configured to set the specific data pattern as a crosstalk-causing data pattern and compare the specific data pattern with the image data signal, and an interface configured to update data related to compensation of the grayscale voltage according to the result of the comparison by the timing controller, and provide the voltage generator with the updated data.

In an exemplary embodiment, the interface may provide predetermined time information and predetermined voltage information according to the result of the comparison.

In an exemplary embodiment, the voltage generator may provide the grayscale voltage that is desired by the display, and the voltage generator may be controlled by the voltage compensation controller to compensate a gamma voltage with a predetermined condition according to a result of a comparison by the voltage compensation controller, and to supply the grayscale voltage using the compensated gamma voltage, thereby supplying the compensated grayscale voltage.

In an exemplary embodiment, the voltage generator may include a digital gamma voltage generator configured to generate the gamma voltage, and a digital grayscale voltage generator configured to receive the gamma voltage and modulate the gamma voltage with a predetermined time condition and a predetermined voltage condition under control of the voltage compensation controller to supply the compensated grayscale voltage.

According to an exemplary embodiment of the inventive concept, an LCD device includes a timing controller, an interface and a voltage generator. The timing controller is configured to control a panel and process a signal of image data according to an operation condition of the panel, and compare the image data with a predetermined crosstalk-causing data pattern. The interface is coupled to the timing controller, and updates a data packet to compensate for the crosstalk-causing data pattern when the crosstalk-causing data pattern occurs. The voltage generator is configured to compensate a gamma voltage by receiving the data packet under control of the interface.

In an exemplary embodiment, the timing controller may include a pattern data detector configured to compare the image data signal with the predetermined crosstalk-causing data pattern, and a lookup table configured to store a plurality of time conditions and a plurality of voltage conditions each corresponding to a crosstalk-causing data pattern.

In an exemplary embodiment, when the crosstalk-causing data pattern is detected while a plurality of pieces of the packet data are provided, the interface may provide the voltage generator with the data packet having information about a predetermined time condition and a predetermined voltage condition added to the data packet according to the result of the detection.

In an exemplary embodiment, the voltage generator may supply a grayscale voltage desired by the panel, and when the crosstalk-causing data pattern occurs, adjust the gamma voltage to supply the compensated grayscale voltage.

In an exemplary embodiment, the voltage generator may include a digital gamma voltage generator configured to generate a digital reference gamma voltage as the gamma voltage, and a digital grayscale voltage generator configured to supply the grayscale voltage using the digital reference gamma voltage. The voltage generator may modulate the digital reference gamma voltage with a predetermined time condition and a predetermined voltage condition under control of the interface to supply the compensated grayscale voltage.

In an exemplary embodiment, the digital gamma voltage generator may include a plurality of digital gamma buffers.

In an exemplary embodiment, the digital grayscale voltage generator may include a resistor string coupled to the digital reference gamma voltage, and a pre-decoder coupled to the resistor string.

In an exemplary embodiment, when the crosstalk-causing pattern occurs, the digital reference gamma voltage may be compensated and supplied with the predetermined time condition and the predetermined voltage condition according to the data packet of the interface.

In an exemplary embodiment, when the crosstalk causing pattern occurs, the pre-decoder may selectively output the compensated gamma voltage.

According to an exemplary embodiment of the inventive concept, an LCD device includes a display including a plurality of pixels, a voltage compensation controller configured to control the plurality of pixels and determine whether to compensate a predetermined grayscale voltage to be applied to the plurality of pixels, and a voltage generator configured to provide the predetermined grayscale voltage to the plurality of pixels in response to the voltage compensation controller determining not to compensate the predetermined grayscale voltage, and to compensate the predetermined grayscale voltage and provide the compensated predetermined grayscale voltage to the plurality of pixels in response to the voltage compensation controller determining to compensate the predetermined grayscale voltage.

In an exemplary embodiment, the voltage compensation controller includes a timing controller configured to compare the image data with the crosstalk-causing data pattern, and an interface configured to update data relating to compensation of the predetermined grayscale voltage based on the comparison result obtained by comparing the image data with the crosstalk-causing data pattern, and provide the voltage generator with the updated data.

In an exemplary embodiment, the interface is configured to generate predetermined time information and predetermined voltage information based on the comparison result obtained by comparing the image data with the cross-talk causing data pattern.

In an exemplary embodiment, the voltage generator is controlled by the voltage compensation controller, and the voltage generator is configured to compensate a gamma voltage based on the comparison result obtained by comparing the image data with the cross-talk causing data pattern, and provide the compensated predetermined grayscale voltage to the plurality of pixels using the compensated gamma voltage.

In an exemplary embodiment, the voltage generator includes a digital gamma voltage generator configured to generate the gamma voltage, and a digital grayscale voltage generator configured to receive the gamma voltage and modulate the gamma voltage using a predetermined time condition and a predetermined voltage condition under control of the voltage compensation controller to provide the compensated predetermined grayscale voltage to the plurality of pixels.

In an exemplary embodiment, the voltage generator is configured to compensate the predetermined grayscale voltage without referencing a common voltage applied to the plurality of pixels.

According to an exemplary embodiment of the inventive concept, an LCD device includes a timing controller configured to control a display panel, receive image data, and compare the image data with a predetermined crosstalk-causing data pattern to determine whether crosstalk exists, an interface coupled to the timing controller, and configured to update a data packet to compensate for the predetermined crosstalk-causing data pattern in response to the timing controller determining that the crosstalk exists, and a voltage generator configured to compensate a gamma voltage using the data packet under control of the interface in response to the timing controller determining that the crosstalk exists.

In an exemplary embodiment, the timing controller includes a pattern data detector configured to compare the image data with the predetermined crosstalk-causing data pattern, and a lookup table configured to store a plurality of time conditions and a plurality of voltage conditions, each corresponding to one of a plurality of crosstalk-causing data patterns. The predetermined crosstalk-causing data pattern is one of the plurality of crosstalk-causing data patterns.

In an exemplary embodiment, the data packet includes a predetermined time condition and a predetermined voltage condition.

In an exemplary embodiment, the voltage generator is configured to adjust the gamma voltage to provide a compensated grayscale voltage to a plurality of pixels of the display panel in response to the timing controller determining that the crosstalk exists.

In an exemplary embodiment, the voltage generator includes a digital gamma voltage generator configured to generate a digital reference gamma voltage as the gamma voltage, and a digital grayscale voltage generator configured to provide the compensated grayscale voltage to the plurality of pixels using the digital reference gamma voltage. The voltage generator is configured to modulate the digital reference gamma voltage using a predetermined time condition and a predetermined voltage condition under control of the interface to provide the compensated grayscale voltage to the plurality of pixels.

In an exemplary embodiment, the digital gamma voltage generator includes a plurality of digital gamma buffers.

In an exemplary embodiment, the digital grayscale voltage generator includes a resistor string configured to receive the digital reference gamma voltage, and a pre-decoder coupled to the resistor string.

In an exemplary embodiment, the digital reference gamma voltage is compensated using the predetermined time condition and the predetermined voltage condition based on the data packet in response to the timing controller determining that the crosstalk exists.

In an exemplary embodiment, the pre-decoder is configured to output the compensated grayscale voltage in response to the timing controller determining that the crosstalk exists.

In an exemplary embodiment, the voltage generator is configured to compensate the gamma voltage without referencing a common voltage applied to a plurality of pixels.

In an exemplary embodiment, a method of driving an LCD device includes receiving image data at the LCD device, and comparing the image data with a preset crosstalk-causing data pattern. The preset crosstalk-causing data pattern corresponds to a data pattern predetermined to cause crosstalk. The method further includes determining whether to compensate a predetermined grayscale voltage to be applied to a plurality of pixels of the LCD device based on a comparison result obtained by comparing the image data with the preset crosstalk-causing data pattern, compensating the predetermined grayscale voltage and applying the compensated predetermined grayscale voltage to the plurality of pixels when the comparison result indicates that the image data and the preset crosstalk-causing data pattern match, and applying the predetermined grayscale voltage to the plurality of pixels without compensation when the comparison result indicates that the image data and the preset crosstalk-causing data pattern do not match.

In an exemplary embodiment, compensating the predetermined grayscale voltage is performed without referencing a common voltage applied to the plurality of pixels.

In an exemplary embodiment, the preset crosstalk-causing data pattern is one of a plurality of preset crosstalk-causing data patterns, and comparing the image data comprises comparing the image data to each of the plurality of preset crosstalk-causing data patterns.

BRIEF DESCRIPTION OF THE DRAWINGS

The above and other features of the present inventive concept will become more apparent by describing in detail exemplary embodiments thereof with reference to the accompanying drawings, in which.

DETAILED DESCRIPTION OF THE EXEMPLARY EMBODIMENTS

Figure 1:
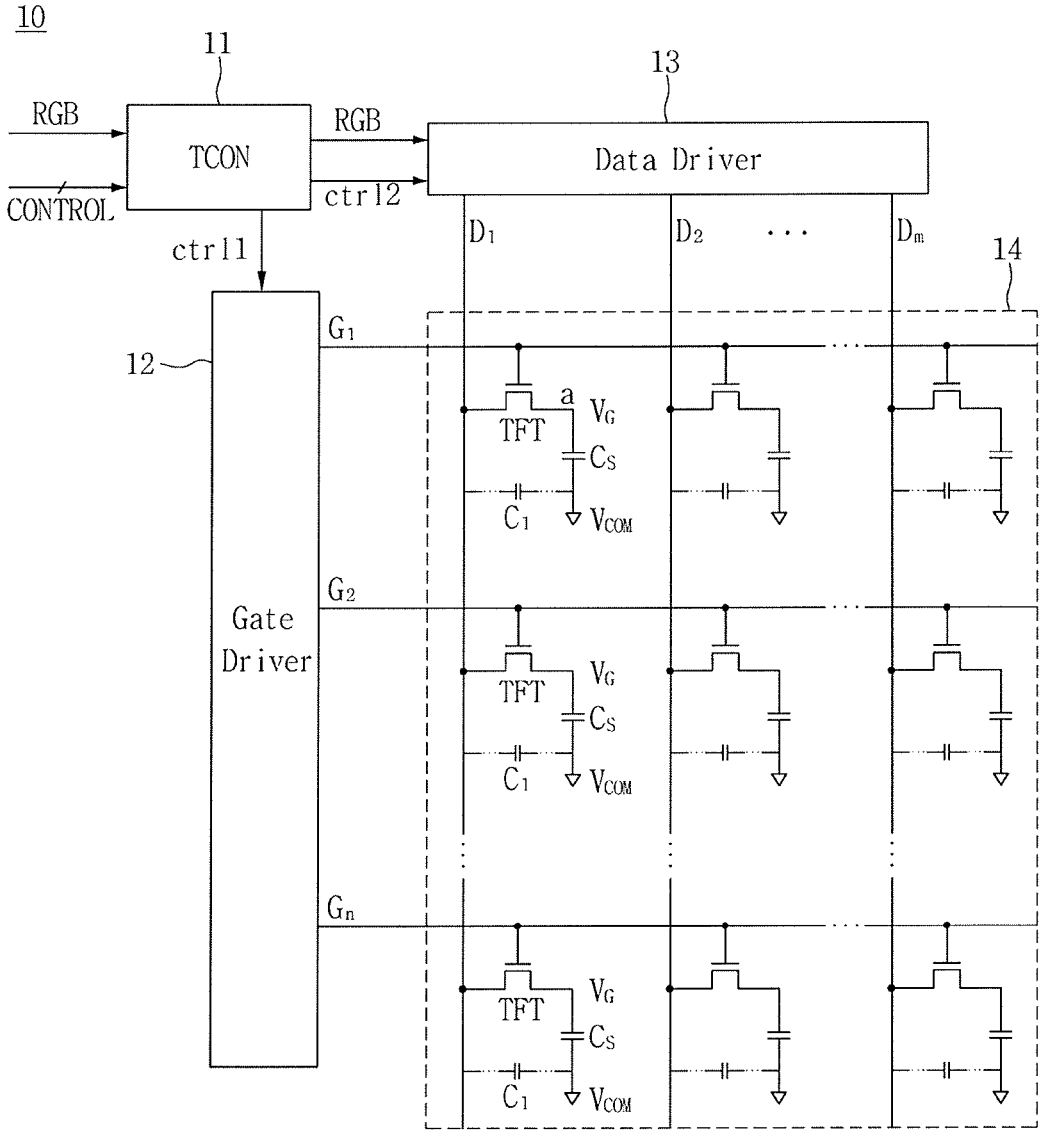
FIG. 1 is a block diagram showing a liquid crystal display (LCD) device.

Exemplary embodiments of the present inventive concept will be described more fully hereinafter with reference to the accompanying drawings. Like reference numerals may refer to like elements throughout the accompanying drawings.

It will be understood that when an element or layer is referred to as being "on," "connected to" or "coupled to" another element or layer, it can be directly on, connected or coupled to the other element or layer or intervening elements or layers may be present.

It will be understood that although the terms "first," " second," " third," etc., may be used herein to describe various elements, components, regions, layers and/or sections, these elements, components, regions, layers and/or sections should not be limited by these terms. These terms are only used to distinguish one element, component, region, layer, or section from another element, component, region, layer, or section. Thus, a first element, component, region, layer, or section described below could be termed a second element, component, region, layer, or section without departing from the teachings of the present inventive concept.

Spatially relative terms, such as "beneath," "below," "lower," "above," "upper," etc., may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below.

Herein, when two or more elements or values are described as being substantially the same as each other, it is to be understood that the elements or values are identical to each other, indistinguishable from each other, or distinguishable from each other but functionally the same as each other as would be understood by a person having ordinary skill in the art.

FIG. 1 is a block diagram showing a liquid crystal display (LCD) device.

Referring to FIG. 1, an LCD device 10 includes a timing controller (TCON) 11, a gate driver 12, a data driver 13 and a display panel 14.

The timing controller 11 receives image data RGB and various control signals CONTROL from an external source. The various control signals CONTROL are used to control operations of the gate driver 12 and the data driver 13. The various control signals CONTROL may include, for example, a horizontal synchronizing signal, a vertical synchronizing signal, a clock signal, etc. The image data RGB may include, for example, red image data (R), green image data (G) and blue image data (B), however, the image data RGB is not limited thereto.

The timing controller 11 may provide the gate driver 12 and the data driver 13 with general control signals including, for example, a gate drive signal ctr11 and a data drive signal ctr12, respectively, to control operations of the gate driver 12 and the data driver 13. The timing controller 11 may process image data signals received from the external source. For example, red (R), green (G) and blue (B) image data signals may be processed by the timing controller 11 according to an operational condition of the display panel 14, and the timing controller 11 may provide the data driver 13 with the processed signals.

The gate driver 12 sequentially supplies gate turn-on voltages to gate lines $G_1, G_2, \ldots G_n$ provided in the display panel 14. In this manner, the gate driver 12 controls the turning on of a corresponding cell transistor in order to apply a grayscale voltage to each pixel in the display panel 14.

The data driver 13 is controlled by the timing controller 11, and supplies image data R, G and B (e.g., pixel data) to the data lines $D_1$, $D_2$, of the display panel 14 to drive red, green and blue pixels of the display panel 14.

The display panel 14 includes a plurality of unit pixels arranged in a matrix formation at intersections of the gate lines $G_1$ to $G_n$ and the data lines $D_1$ to $D_m$.

A unit pixel includes a switching device (e.g., a thin-film transistor (TFT)) coupled to a gate line and a data line, and a liquid crystal capacitor Cs coupled to the switching device TFT. The liquid crystal capacitor Cs has one terminal connected to a drain terminal a of the switching device TFT and another terminal connected to a common voltage $V_{COM}$ (e.g., the voltage at a common electrode), and a dielectric layer having dielectric anisotropy is interposed between the two terminals.

The unit pixel operates in the following manner. A drive signal is applied to a gate line by the gate driver 12 and switching devices TFT coupled to the gate line are turned on. Pixel data applied to the data lines $D_1$ to $D_m$ by the data driver 13 is transmitted to drain terminals a of the switching devices TFT, which are turned on by the gate driver 12, through the switching devices TFT. The liquid crystal alignment of liquid crystal cells in a liquid crystal layer of the display panel 14 is changed as a result of an electric field being applied to the liquid crystal capacitor Cs, and thereby, an image is displayed.

When the LCD device 10 displays a specific data pattern, a parasitic capacitance $C_1$ may occur between a common electrode having the common voltage $V_{COM}$ and a data line $D_1$ due to interference between pixels. As a result, a voltage of the common electrode may be distorted.

A predetermined pixel voltage is expected to be applied to a liquid crystal capacitor $C_S$, as described in Equation 1 below:

$$Vcs=V_G-V_{COM} \quad \text{[Equation 1]}$$

Referring to Equation 1, Vcs is a voltage of a liquid crystal capacitor, $V_G$ is a voltage of a drain terminal a, and $V_{COM}$ is a voltage applied to a common electrode.

That is, the voltage applied to the liquid crystal capacitor Cs is a predetermined expected voltage defined as the difference between the grayscale voltage applied to the drain terminal a of the switching device TFT and the common voltage $V_{COM}$ applied to the common electrode.

In this case, due to a parasitic capacitance $C_1$, a common voltage is assumed to have a parasitic component added thereto, resulting in $V_{COM}$+a. According to Equation 1, the predetermined expected value of a voltage Vcs applied to the liquid capacitor C is reduced by $\alpha$. That is, as a ripple is caused in a common voltage $V_{COM}$ due to interference between pixels, a color is displayed differently from a desired color, and the image quality may be lowered. This phenomenon may be referred to as crosstalk.

Figure 2:
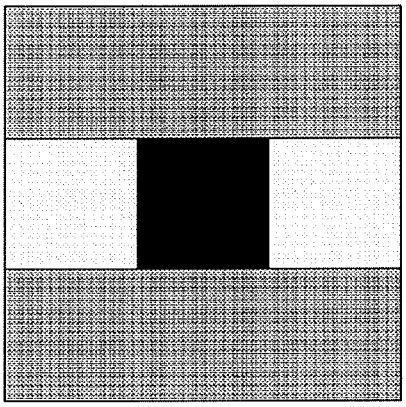
FIG. 2 illustrates a crosstalk phenomenon.

FIG. 2 illustrates a crosstalk phenomenon.

Referring to FIG. 2, a voltage of a pixel is changed due to an undesired parasitic component in a specific display pattern, causing an abnormal display of a specific pattern. In this case, the image quality is lowered.

Figure 3:
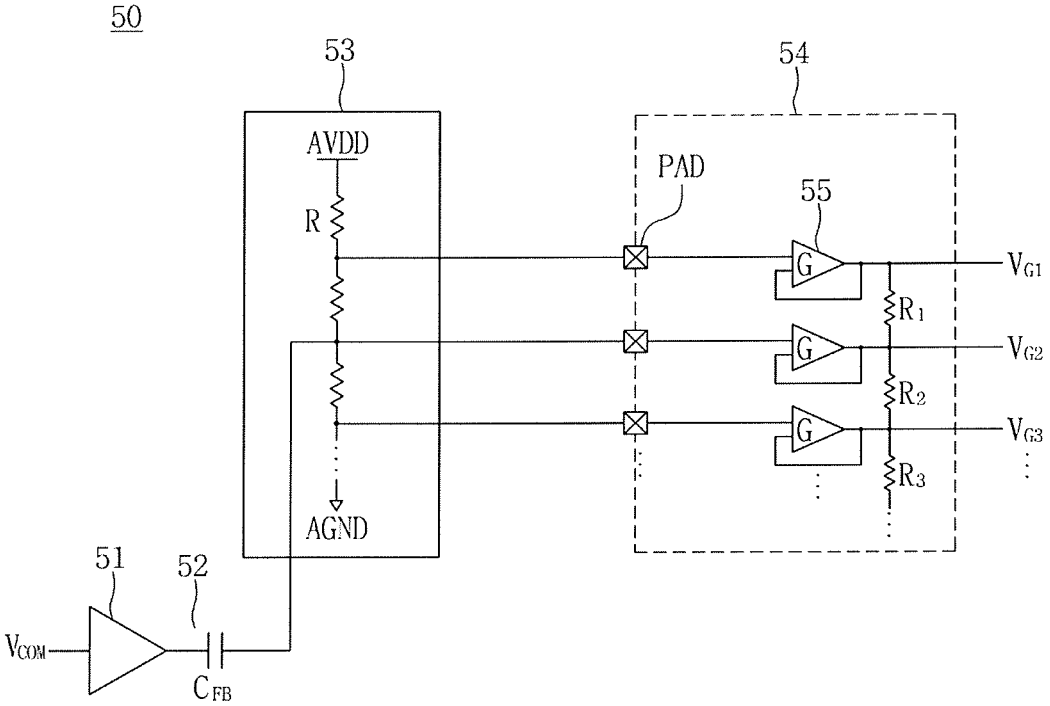
FIG. 3 is a block diagram illustrating a compensation voltage block configured to compensate for a crosstalk phenomenon.

FIG. 3 is a block diagram illustrating a compensation voltage block configured to compensate for a crosstalk phenomenon.

Referring to FIG. 3, a compensation voltage block 50 includes, for example, a voltage buffer 51, a feedback capacitor 52, a gamma voltage generator 53 and a grayscale voltage generator 54.

The voltage buffer 51 buffers a common voltage $V_{COM}$ (e.g., a voltage of a common electrode), which is a feedback voltage. The voltage buffer 51 may reflect a common voltage $V_{COM}$ by receiving a feedback common voltage from the display panel 14 (see FIG. 1). The common voltage $V_{COM}$ may have a ripple component introduced by a parasitic capacitance $C_1$ (see FIG. 1).

The feedback capacitor 52 may pass a ripple component of a common voltage $V_{COM}$, that is, an alternating current (AC) component. Accordingly, the ripple component may be additionally provided to the gamma voltage generator 53.

That is, according to a conventional gamma voltage compensation method, a ripple component, which is generated in the common voltage $V_{COM}$, may be added to a gamma voltage in advance. As a result, a difference between a gamma voltage and a common voltage may be controlled to be constant.

The gamma voltage generator 53 may include a plurality of resistors disposed between a power supply voltage AVDD and a ground voltage AGND. For example, the gamma voltage generator 53 may include a resistor string disposed between a power supply voltage AVDD and a ground voltage AGND such that resistances are divided between nodes.

In order to generate 256 grayscale voltages, for example, eight gamma voltages may be used.

In this case, a conventional gamma voltage compensation method may be implemented by allowing a voltage divided at each node (e.g., a gamma voltage) to be output with a ripple voltage of a common voltage $V_{COM}$ added thereto for compensation. Accordingly, a gamma voltage may be generated to have a change substantially corresponding to a change in the common voltage $V_{COM}$.

The grayscale voltage generator 54 may include a pad PAD and a plurality of gamma buffers 55 that receives the divided voltages from the respective nodes.

The grayscale voltage generator 54 may receive a plurality of gamma voltages generated by the gamma voltage generator 53. For convenience of description, grayscale voltages of the grayscale voltage generator 54 are illustrated as being provided in a one-to-one correspondence with the gamma voltages, however, the grayscale voltage generator 54 may be configured such that a plurality of grayscale voltages are output with respect to a single gamma voltage. The resistor string $R_1$, $R_2$, etc. is formed between the plurality of grayscale voltages so that voltages of the respective nodes between the resistor string $R_1$, $R_2$, etc. are output as respective grayscale voltages.

The grayscale voltages $V_{G1}$, $V_{G2}$, etc. are generated from the compensated gamma voltages and are output with a variation corresponding to the ripple. Accordingly, the plurality of grayscale voltages $V_{G1}$, $V_{G2}$, etc. output from the respective gamma buffers 55 may be applied to drain terminals (see a in FIG. 1) of the switching devices TFT of the display panel 14 (see FIG. 1). Accordingly, each pixel voltage may maintain a voltage corresponding to a difference between the respective grayscale voltage $V_{G1}$, $V_{G2}$, etc. and the common voltage, and a crosstalk phenomenon may be reduced. Such a conventional gamma voltage compensation method corresponds to an analog type gamma voltage compensation method.

However, in an analog type gamma voltage compensation method, the effect of a line resistance between the gamma voltage generator 53 and the grayscale voltage generator 54, such as a resistor on glass, is appreciable. That is, the gamma voltage compensated by the gamma voltage generator 53 may not be easily maintained due to the additional resistor on glass. In addition, the additional cost and area required to dispose the voltage buffer 51 and the feedback capacitor 52 may impose limitations on the size of a mobile product when the compensation voltage block 50 is utilized in the mobile product.

Rather than performing an analog type gamma voltage compensation method, a digital type gamma voltage compensation method may be performed.

Hereinafter, a digital type gamma voltage compensation method will be described with reference to FIG. 4.

Figure 4:
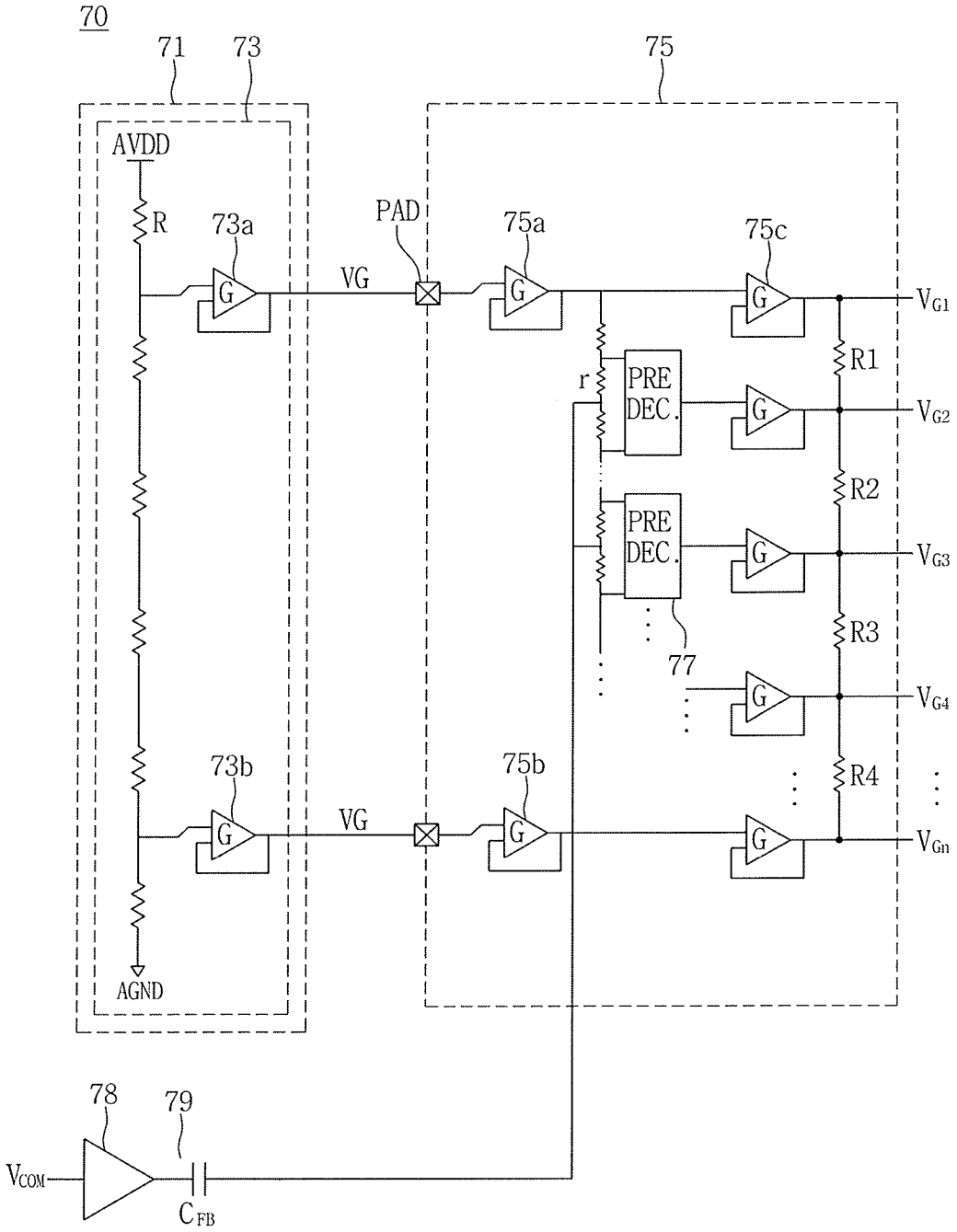
FIG. 4 is a block diagram illustrating a gamma voltage compensation block in accordance with a digital technology.

FIG. 4 is a block diagram illustrating a gamma voltage compensation block 70 in accordance with a digital technology.

Referring to FIG. 4, a gamma voltage compensation block 70 includes a digital gamma voltage generator 71, a digital grayscale voltage generator 75, a voltage buffer 78 and a feedback capacitor 79.

The digital gamma voltage generator 71 includes a power management integrated circuit (PMIC) 73.

The power management integrated circuit 73 represents a domain configured to generate a predetermined voltage, and may be, for example, a power circuit unit configured to generate two reference gamma voltages.

The PMIC 73 includes a string of a plurality of resistors and two digital gamma buffers 73*a* and 73*b* disposed between a power supply voltage AVDD and a ground voltage AGND. Reference gamma voltages VG are provided by the digital gamma buffers 73*a* and 73*b* and are each coupled to a specific node to which a voltage is distributed by the plurality of resistors.

The digital grayscale voltage generator 75 includes pads PAD that receive the reference gamma voltages VG distributed from each node, two digital gamma buffers 75*a* and 75*b*, a plurality of pre-decoders 77 and a plurality of gamma buffers 75*c*.

The reference gamma voltages VG output by the PMIC 73 are buffered via the two digital gamma buffers 75*a* and 75*b* after passing through the pads PAD. In this case, the number of pads PAD, which correspond to the digital gamma buffers 73*a* and 73*b*, is reduced compared to the analog scheme described above.

A string of a plurality of resistors r is provided at input terminals of the pre-decoders 77. Accordingly, the nodes to which voltages are distributed by the resistors r of the string are coupled to the pre-decoders 77. A current path corresponding to the reference gamma voltage VG provided by the digital gamma buffer 75*a* or 75*b* is selected, and is provided to a respective gamma buffer 75*c* through one of the pre-decoders 77. The pre-decoder 77 serves as a switch to transmit a voltage of a selected node.

The gamma buffer 75*c* may allow a grayscale voltage to be output using the received gamma voltage. For convenience of description, the grayscale voltages are illustrated as being output in a one-to-one correspondence with the received gamma voltages, however, a plurality of grayscale voltages may be output from a single gamma voltage.

A plurality of grayscale voltages $V_{G1}, V_{G2}, \ldots V_{Gn}$ output by the gamma buffers 75*c* are applied to drain terminals of the switching devices TFTs of the display panel 14 (see FIG. 1).

According to the digital type gamma voltage compensation scheme, a ripple introduced into a common voltage $V_{COM}$ may be reflected as a feedback common voltage $V_{COM}$ applied to the display panel 14 (see FIG. 1) through the voltage buffer 78 in a manner similar to the analog type gamma voltage compensation method. The feedback capacitor 79 provides the resistor string (e.g., provides an input terminal of the pre-decoder 77) with a common voltage having a ripple voltage added.

Thus, using the digital type gamma voltage compensation scheme, the number of pads PAD of the grayscale voltage generator 75 may be reduced compared to the analog type gamma voltage compensation scheme. However, the design of a product utilizing the gamma voltage compensation block 70 according to the digital type gamma voltage compensation scheme is still limited by the cost and area that are needed to dispose the voltage buffer 78 and the feedback capacitor 79.

Figure 5:
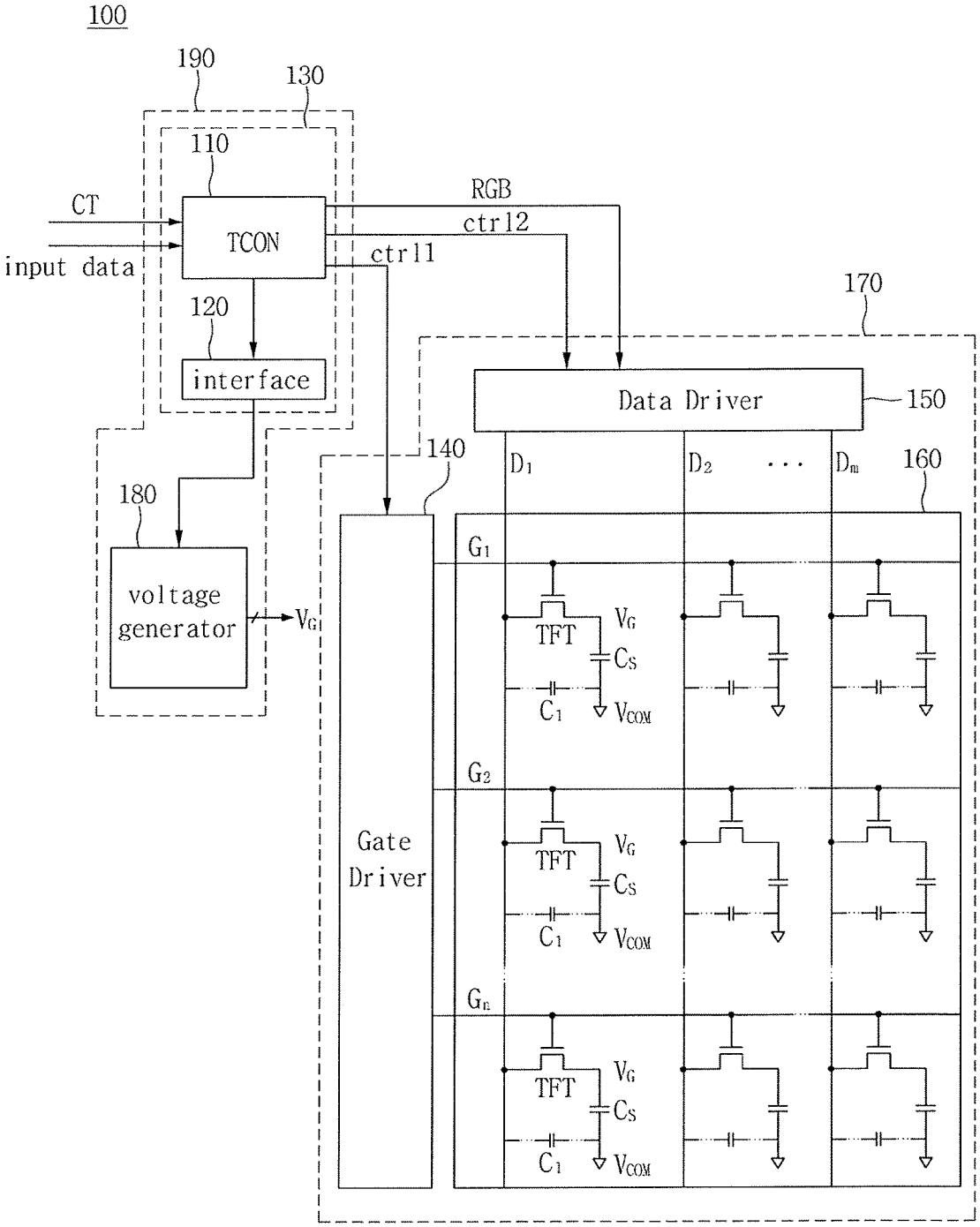
FIG. 5 is a block diagram illustrating an LCD device according to an exemplary embodiment of the inventive concept.

FIG. 5 is a block diagram illustrating an LCD device according to an exemplary embodiment of the inventive concept.

Hereinafter, the configuration and operation of an LCD device 100 including a gamma voltage compensation block 190 according to an exemplary embodiment of the inventive concept will be described with reference to FIG. 5.

Referring to FIG. 5, according to an exemplary embodiment, the LCD device 100 includes a display 170 and a gamma voltage compensation block 190.

The display 170 includes a gate driver 140, a data driver 150 and a display panel 160.

The gate driver 140 sequentially applies gate turn-on voltages to gate lines $G_1$ to $G_n$ disposed in the display panel 160. In this manner, the turning on of a certain cell transistor is controlled such that a grayscale voltage to be applied to each pixel is applied to each pixel. For example, when it is determined that the grayscale voltage is not to be compensated, the original uncompensated grayscale voltage is applied to the pixels. When it is determined that the grayscale voltage is to be compensated, the grayscale voltage is compensated and the compensated grayscale voltage is applied to the pixels.

The data driver 150 provides data lines $D_1$ to $D_m$ of the display panel 160 with image data R, G, and B (e.g., red, green and blue pixel data). It is to be understood that the image data is not limited to red, green and blue pixel data, and the pixels included in the display panel 160 are not limited to red, green and blue pixels.

The display panel 160 includes a plurality of unit pixels arranged in a matrix formation and disposed at intersections of the gate lines $G_1$ to $G_n$ and the data lines $D_1$ to $D_m$. Each unit pixel includes a switching device TFT coupled to a gate line and data line, and a liquid crystal capacitor Cs coupled to the switching device TFT. The liquid crystal capacitor Cs has one terminal connected to a drain terminal of the switching device TFT (e.g., the terminal receiving $V_G$) and another terminal connected to a common voltage $V_{COM}$ (e.g., the voltage at the common electrode). When a specific data pattern is displayed on the LCD device 100, a parasitic capacitance $C_1$ may occur between a common electrode having the common voltage $V_{COM}$ and a data line. Accordingly, a ripple component may be introduced into the voltage at the common electrode (e.g., the common voltage $V_{COM}$), and as a result, the common voltage $V_{COM}$ may be distorted.

In the exemplary embodiment of FIG. 4, the gamma voltage compensation block 190 includes a voltage compensation controller 130 and a voltage generator 180.

The voltage compensation controller 130 may include a timing controller (TCON) 110 and an interface 120.

The timing controller 110 may control operations of the gate driver 140 and the data driver 150 by providing a gate drive signal ctrl1 and a data drive signal ctr12 to the gate driver 140 and the data driver 150, respectively. In addition, the timing controller 110 may process image data signals (e.g., red (R), green (G) and blue (B) data signals) received externally according to an operation condition of the display panel 160, and may provide the processed image data signals to the data driver 150. In addition, the timing controller 110 may compare input data with a preset crosstalk-causing data pattern CT. When the input data is determined to match the crosstalk-causing data pattern CT (e.g., when it is indicated that crosstalk has been detected), the timing controller 110 notifies the interface 120 of the match and the detection of the crosstalk. A match between the input data and the cross-talk causing data pattern CT is determined to exist when the input data and the cross-talk causing data pattern CT are identical or substantially similar to each other.

The interface 120 updates a data packet to compensate for a crosstalk-causing data pattern CT when a crosstalk-causing data pattern CT occurs.

The voltage generator 180 may provide a grayscale voltage $V_G$ that is used by the display 170 to display an image. When a crosstalk-causing data pattern CT occurs, the voltage generator 180 compensates a gamma voltage under control of the interface 120 to provide a compensated grayscale voltage $V_G$.

Figure 6:
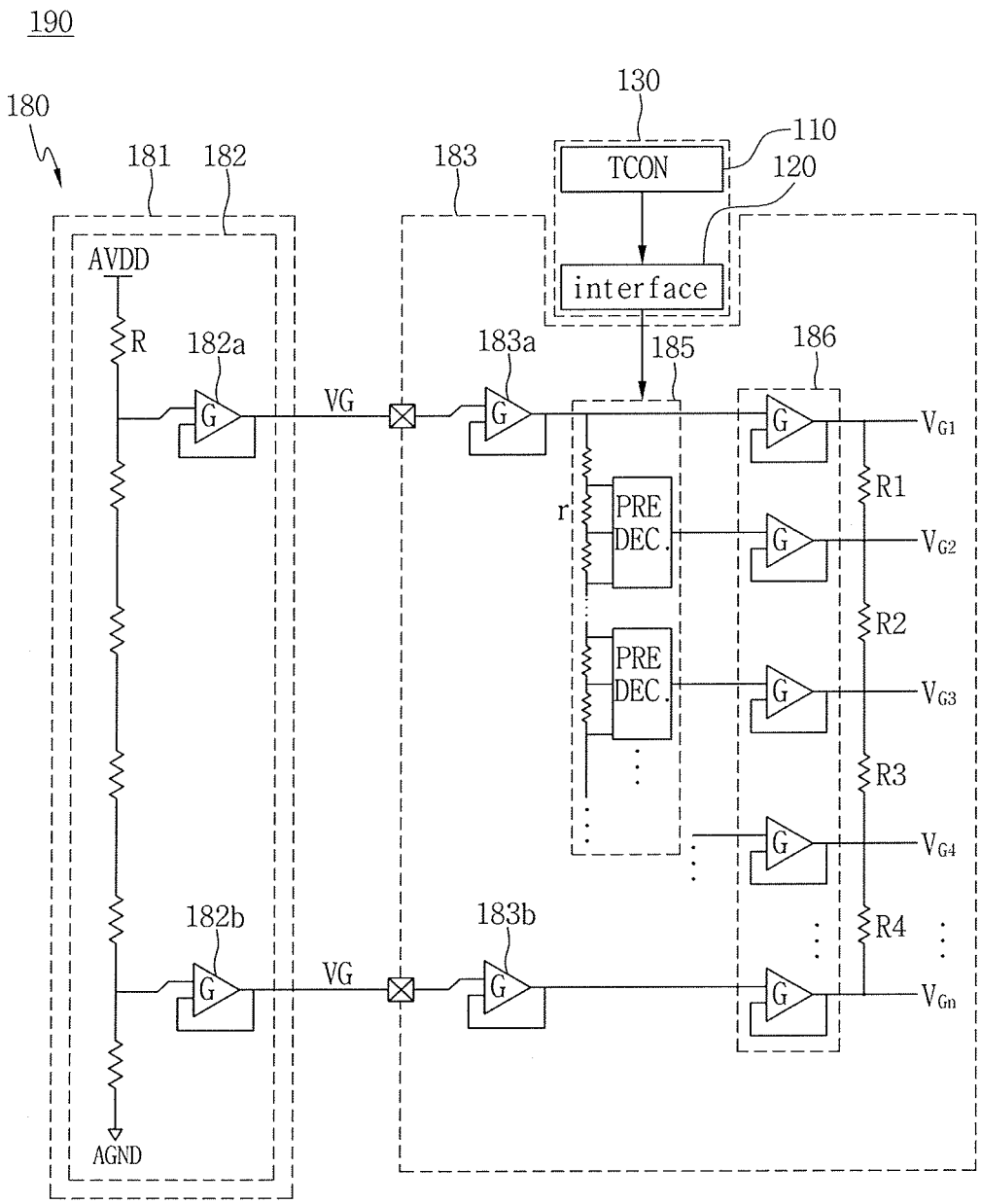
FIG. 6 is a circuit diagram illustrating the gamma voltage compensation block of FIG. 5 according to an exemplary embodiment of the inventive concept.

FIG. 6 is a circuit diagram illustrating the gamma voltage compensation block 190 of FIG. 5 according to an exemplary embodiment of the inventive concept.

The gamma voltage compensation block 190 includes the voltage compensation controller 130 and the voltage generator 180.

The voltage compensation controller 130 includes the timing controller 110 and the interface 120.

The timing controller 110 and the interface 120 will be described in further detail with reference to FIGS. 7 to 9.

The voltage generator 180 includes a digital gamma voltage generator 181 and a digital grayscale voltage generator 183.

The digital gamma voltage generator 181 includes a PMIC 182.

The PMIC 182 represents a domain configured to generate a predetermined voltage, and may be, for example, a power circuit unit configured to generate two digital reference gamma voltages VG.

The PMIC 182 includes a string of a plurality of resistors R and two digital gamma buffers 182*a* and 182*b* disposed between a power supply voltage AVDD and a ground voltage AGND. Reference gamma voltages VG are provided from the digital gamma buffers 182*a* and 182*b* to the digital grayscale voltage generator 183. For example, the digital gamma buffers 182*a* and 182*b* are each coupled to a specific node to which a voltage is distributed by the plurality of resistors R.

The digital grayscale voltage generator 183 includes pads PAD that receive the digital reference gamma voltages VG distributed from each node, two digital gamma buffers 183*a* and 183*b*, a grayscale voltage selection unit 185 and a gamma buffer unit 186.

The digital reference gamma voltages VG output by the PMIC 182 are buffered via the two digital gamma buffers 183*a* and 183*b* after passing through the pads PAD.

The grayscale voltage selection unit 185 includes a string of a plurality of resistors r and a plurality of pre-decoders Pre DEC coupled to the string of the plurality of resistors. The nodes to which voltages are distributed by the resistors of the resistor string are coupled to the pre-decoders PRE DEC. A current path corresponding to the reference gamma voltage VG provided by the digital gamma buffer 183*a* or 183*b* is selected through the resistor string and provided to the gamma buffer unit 186 through one of the pre-decoders PRE DEC. The pre-decoder PRE DEC serves as a switch to output a voltage of a selected node.

According to exemplary embodiments of the inventive concept, the timing controller 110 may detect the existence of crosstalk using a crosstalk-causing data pattern CT.

As described above, in terms of voltage, when crosstalk occurs, a ripple component may be introduced into a common voltage. Rather than directly compensating a gamma voltage according to this voltage difference, according to exemplary embodiments of the inventive concept, crosstalk is regarded as interference caused by a specific data pattern (e.g., a certain data pattern(s) that has been predetermined as a data pattern likely to cause crosstalk). Therefore, rather than compensating the gamma voltage by receiving feedback of a common voltage $V_{COM}$ ripple, exemplary embodiments provide a gamma voltage modulated without feedback of a common voltage $V_{COM}$ upon occurrence of a specific data pattern. That is, according to exemplary embodiments, compensation is performed without referencing the common voltage $V_{COM}$.

For example, the timing controller 110 provides the interface 120 with a control signal configured to provide a compensation voltage to reduce crosstalk when a crosstalk-causing data pattern CT is detected. The interface 120 updates packet information in response to the received control signal, and provides the pre-decoder PRE DEC with a voltage with which a gamma voltage is compensated and time information regarding compensation of the gamma voltage.

Accordingly, the pre-decoder PRE DEC may selectively output a compensated gamma voltage upon receiving specific crosstalk-causing data pattern data, and thus, a crosstalk phenomenon may be reduced.

According to exemplary embodiments of the present inventive concept, feedback of a ripple of a common voltage $V_{COM}$ is not used to reduce crosstalk, and thus, an additional feedback line, a feedback capacitor and a voltage buffer may be omitted from devices designed according to exemplary embodiments of the inventive concept.

According to exemplary embodiments of the inventive concept, a gamma voltage is selected in a digital manner while eliminating the effects of parasitic resistances that may be generated during the process of receiving feedback of a common voltage ripple. Exemplary embodiments provide an LCD display device with improved crosstalk characteristics having a reduced cost and a reduced thickness by way of for example, the removal of feedback lines.

Subsequently, the respective gamma buffers of the gamma buffer unit 186 may output grayscale voltages using the compensated gamma voltages.

The plurality of grayscale voltages $V_{G1}$ $^{to}$ $V_G$, output by the gamma buffers of the gamma buffer unit 186 are applied to drain terminals of the switching devices TFT of the display panel 160 (see FIG. 5).

Figure 7:
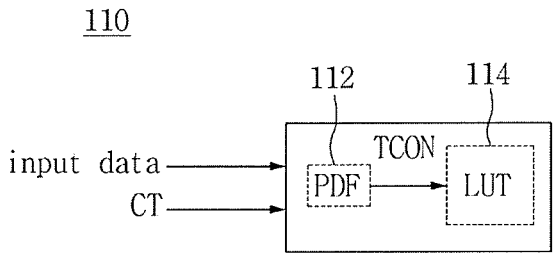
FIG. 7 is a schematic block diagram illustrating the timing controller of FIGS. 5 and 6 according to an exemplary embodiment of the inventive concept.

FIG. 7 is a schematic block diagram illustrating the timing controller 110 of FIGS. 5 and 6 according to an exemplary embodiment of the inventive concept. FIG. 8 is a block diagram illustrating a pattern data detector (PDF) 112 of the timing controller 110 according to an exemplary embodiment of the inventive concept. FIG. 9 is a block diagram illustrating a lookup table (LUT) 114 of the timing controller 110 according to an exemplary embodiment of the inventive concept.

Figure 8:
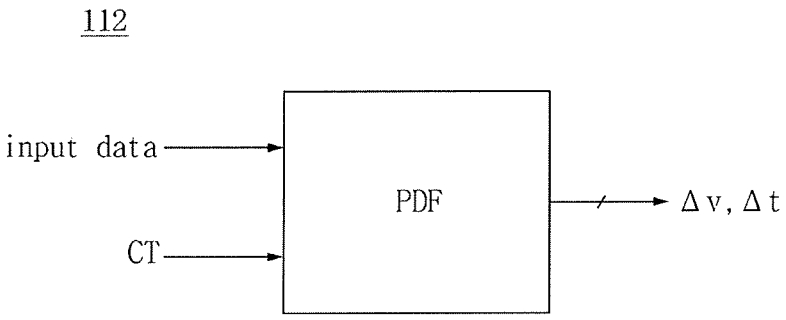
FIG. 8 is a block diagram illustrating a pattern data detector of the timing controller of FIG. 7 according to an exemplary embodiment of the inventive concept.
Figures 9, 10:
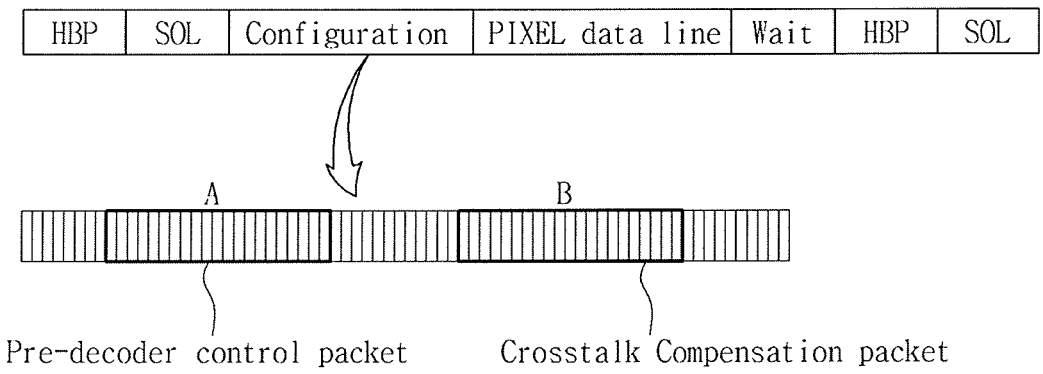
FIG. 9 is a block diagram illustrating a lookup table of the timing controller of FIG. 7 according to an exemplary embodiment of the inventive concept.
FIG. 10 shows a packet of the interface of FIG. 5 according to an exemplary embodiment of the inventive concept.

Referring to FIGS. 7 to 9, according to exemplary embodiments, the timing controller 110 includes the pattern data detector 112 and the lookup table 114.

The pattern data detector 112 performs a pattern detection function. For example, the pattern data detector 112 compares input data with a preset crosstalk-causing data pattern CT to determine whether the input data corresponds to a crosstalk-causing data pattern CT. The preset crosstalk-causing data pattern CT may be one of a plurality of preset crosstalk-causing data patterns CT, and the input data may be compared to each of the plurality of preset crosstalk-causing data patterns CT to determine whether a match exists. The PDF 112 outputs a control signal to compensate an output gamma voltage with a specific voltage and a specific time if the input data is determined to be data matching a crosstalk-causing data pattern CT.

A specific voltage condition and a specific time condition are selected from the lookup table 114 according to currently input crosstalk-causing data pattern data CT.

The lookup table 114 has a plurality of voltage conditions and a plurality of time conditions set therein, and outputs a voltage condition and a time condition, each of which correspond to specific crosstalk-causing data pattern data CT.

FIG. 10 shows a packet of the interface 120 of FIG. 5 according to an exemplary embodiment of the inventive concept.

Referring to FIG. 10, a packet of the interface 120 is composed according to a process sequence including a standby stage (horizontal blank period: HBP), a packet data transmission start recognition stage (start of line: SOL), a data stream transmission stage (Configuration), a pixel data line stage (Pixel data line), a wait stage (Wait), HBP, SOL, etc.

HBP is a time interval during which a previous action is maintained while driving a corresponding horizontal line until line data having display information about the next horizontal line is received.

SOL is a time interval at which the timing controller 110 recognizes that a data stream starts to be transmitted to the data driver 150.

The data stream transmission stage (Configuration) includes packet data A including pre-decoder control data and packet data B including crosstalk compensation data. That is, the interface 120 may send control data, which is configured to control the pre-decoder (PRE DEC in FIG. 6), together with crosstalk compensation data Δt, Δv. As described above, when a crosstalk-causing data pattern CT is detected while a predetermined gamma voltage is provided, the crosstalk compensation data Δt, Δv for the detected crosstalk-causing data pattern CT is added to the control data to provide a gamma voltage compensated with a predetermined time and a predetermined voltage.

In the pixel data line stage, display data (e.g., pixel data) may be transmitted to the data driver 150.

In the wait stage, the data driver 150 may process the pixel data.

The standby stage (HBP) is performed until a new data stream is received, and is followed by the packet data transmission start recognition stage (SOL).

It is to be understood that the packet of the interface 120 shown in FIG. 10 is exemplary, and exemplary embodiments are not limited thereto. For example, the sequence of processes described with reference to FIG. 10 is not limited thereto.

According to exemplary embodiments of the present inventive concept, to reduce a crosstalk phenomenon, a crosstalk-causing data pattern data is detected, and according to the detected crosstalk-causing data pattern data, a gamma voltage is compensated using a predetermined time and a predetermined voltage to provide a modulated gamma voltage.

Referring to FIGS. 5-7, according to an exemplary embodiment of the inventive concept, to prevent a crosstalk phenomenon from occurring due to, for example, interference between pixels in a crosstalk-causing data pattern CT, a crosstalk-causing data pattern CT is detected and a predetermined voltage and a predetermined duration for compensation are selected from the lookup table 114 and provided to the interface 120. Accordingly, the interface 120 updates packet data to have compensation information added thereto, and provides the voltage generator 180 with the updated packet data to which the compensation information has been added. The grayscale voltage selector 185 is controlled to provide a predetermined grayscale voltage, and when a specific pattern occurs, apply a predetermined compensated voltage for a predetermined time.

According to exemplary embodiments, a crosstalk phenomenon may be reduced by compensating a gamma voltage and a grayscale voltage in response to a ripple component of a common voltage $V_{COM}$ without additional hardware such as, for example, feedback components.

Figure 11:
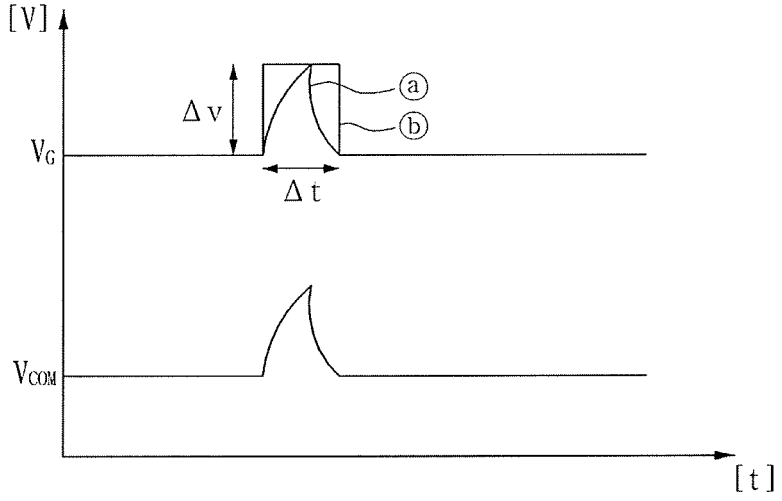
FIG. 11 is a graph showing a gamma voltage of the LCD device of FIG. 5 being substantially compensated according to an exemplary embodiment of the inventive concept.

FIG. 11 is a graph showing a gamma voltage of the LCD device 100 of FIG. 5 being substantially compensated according to an exemplary embodiment of the inventive concept.

Referring to FIG. 11, the x-axis represents time and the y-axis represents voltage.

A predetermined common voltage $V_{COM}$ is provided, and when a ripple component due to a crosstalk-causing data pattern CT is introduced into the common voltage $V_{COM}$, a voltage abnormality may occur.

According to a conventional compensation scheme ⓐ, compensation is performed according to a size of the common voltage $V_{COM}$ to reduce the difference. To implement this scheme, physical configurations of a feedback line and a feedback capacitor are additionally required, and as a result, parasitic resistance components due to the added line and capacitor are appreciable.

The compensation scheme ⓑ according to exemplary embodiments of the inventive concept is implemented in a digital manner based on a voltage that is substantially equal in size to a ripple of a common voltage $V_{COM}$ to be added, and a predetermined amount of time during which the voltage is applied. As a result, exemplary embodiments of the present invention may be implemented without requiring the inclusion of additional feedback component such as, for example, a feedback line and a feedback capacitor.

According to an exemplary embodiment of the inventive concept, a method of driving an LCD device includes receiving image data at the LCD device and comparing the image data with a preset crosstalk-causing data pattern. The preset crosstalk-causing data pattern corresponds to a data pattern predetermined to cause crosstalk. The method further includes determining whether to compensate a predetermined grayscale voltage to be applied to a plurality of pixels of the LCD device based on a comparison result obtained by comparing the image data with the preset crosstalk-causing data pattern, compensating the predetermined grayscale voltage and applying the compensated predetermined grayscale voltage to the plurality of pixels when the comparison result indicates that the image data and the preset crosstalk-causing data pattern match, and applying the predetermined grayscale voltage to the plurality of pixels without compensation when the comparison result indicates that the image data and the preset crosstalk-causing data pattern do not match.

Figure 12:
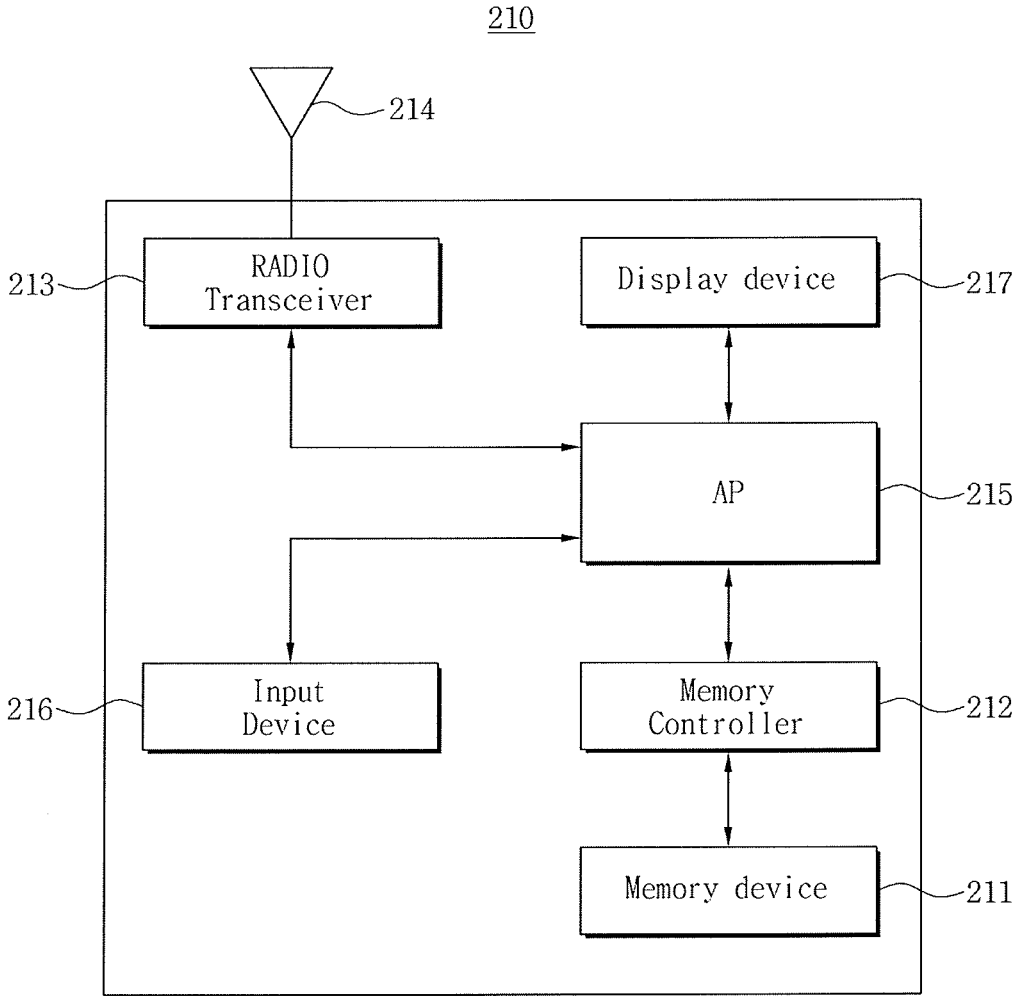
FIG. 12 is a diagram illustrating a computer system including the LCD device shown in FIG. 5 according to an exemplary embodiment of the inventive concept.

FIG. 12 is a diagram illustrating a computer system 210 including the LCD device 100 shown in FIG. 5 according to an exemplary embodiment of the inventive concept.

Referring to FIG. 12, a computer system 210 includes, for example, a memory device 211, a memory controller 212 for controlling the memory device 211, a radio transceiver 213, an antenna 214, an application processor (AP) 215, an input device 216 and a display device 217 (e.g., the LCD device 100 shown in FIG. 5).

The radio transceiver 213 may transmit or receive wireless signals through the antenna 214. For example, the radio transceiver 213 may convert a wireless signal received through the antenna 214 to a signal that may be processed by the application processor 215.

Accordingly, the application processor 215 may process a signal output from the radio transceiver 213, and may transmit the processed signal to the display device 217. In addition, the radio transceiver 213 may convert a signal output from the application processor 215 to a wireless signal, and may output the converted wireless signal to an external device through the antenna 214.

The input device 216 is configured to input a control signal that controls an operation of the application processor 215 or data to be processed by the application processor 215. The input device 216 may be, for example, a pointing device such as a touch pad or a computer mouse, a keypad, a keyboard, etc.

In an exemplary embodiment of the inventive concept, the memory controller 212 that controls an operation of the memory device 211 may be implemented as part of the application processor 215 or as an additional component disposed separate from the application processor 215.

Figure 13:
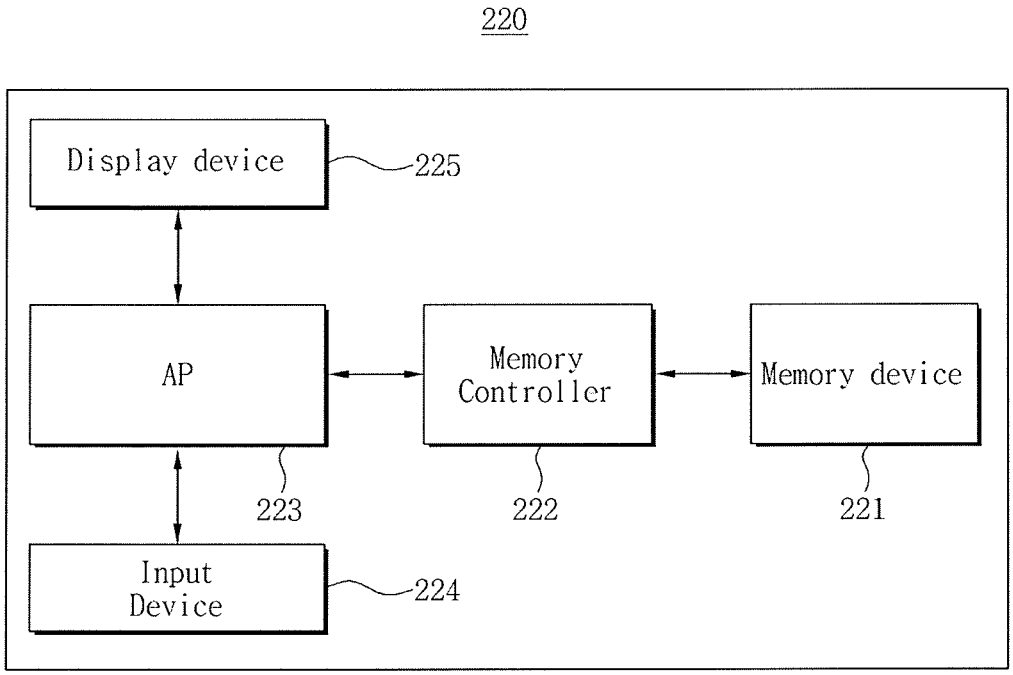
FIG. 13 is a diagram illustrating a computer system including the LCD device shown in FIG. 5 according to an exemplary embodiment of the inventive concept.

FIG. 13 is a diagram illustrating a computer system 220 including the LCD device 100 shown in FIG. 5 according to an exemplary embodiment of the inventive concept.

Referring to FIG. 13, the computer system 220 may be, for example, a personal computer (PC), a network server, a smartphone, a tablet PC, a net-book, an e-reader, a personal digital assistant (PDA), a portable multimedia player (PMP), an MP3 player, an MP4 player, etc.

The computer system 220 includes a memory device 221, a memory controller 222 configured to control a data processing operation of the memory device 221, an application processor 223, an input device 224 and a display device 225 (e.g., the LCD device 100 shown in FIG. 5).

The application processor 223 may allow data stored in the memory device 221 to be displayed on the display device 225 according to data that is input through the input device 224. The input device 224 may be a pointing device such as, for example, a touch pad or a computer mouse, a keypad, a keyboard, etc. The application processor 223 may control the overall operation of the computer system 220, and may control the operation of the memory controller 222.

According to exemplary embodiments of the inventive concept, the memory controller 222 may be implemented as part of the application processor 223 or as a component located separate from the application processor 223.

Figure 14:
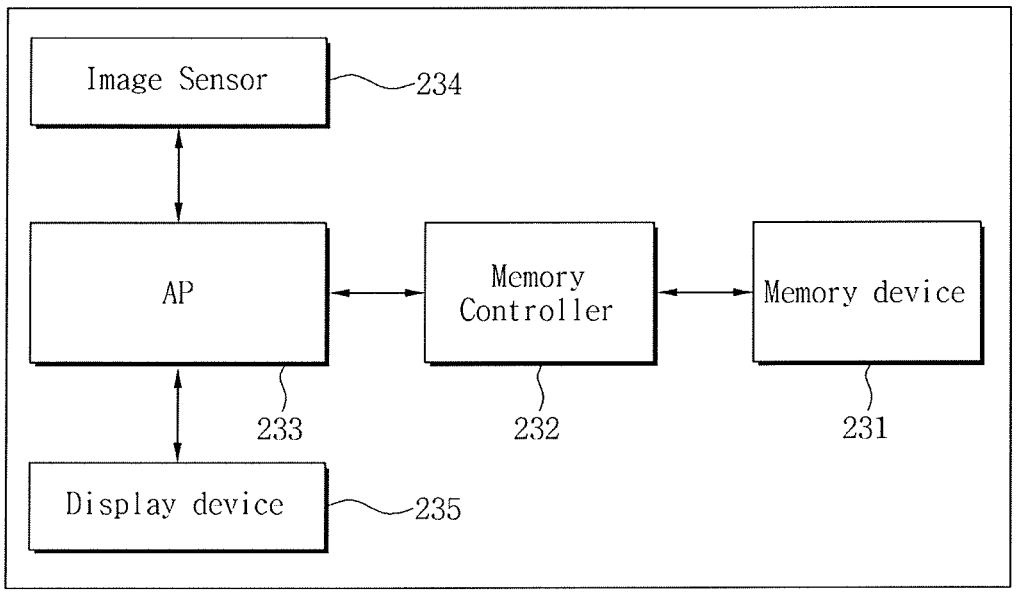
FIG. 14 is a diagram illustrating a computer system 230 including the LCD device shown in FIG. 5 according to an exemplary embodiment of the inventive concept.

FIG. 14 is a diagram illustrating a computer system 230 including the LCD device 100 shown in FIG. 5 according to an exemplary embodiment of the inventive concept.

Referring to FIG. 14, the computer system 230 may be an image processing device such as, for example, a digital camera, a mobile phone having a digital camera attached thereto, a smartphone having a digital camera attached thereto, a tablet PC having a camera attached thereto, etc.

The computer system 230 includes a memory device 231 and a memory controller 232 that controls a data process operation of the memory device 231 such as, for example, a write operation or a read operation. In addition, the computer system 230 may further include an application processor 233, an image sensor 234 and a display device 235 (e.g., the LCD display device 100 shown in FIG. 5).

An image sensor 234 of the computer system 230 converts an optical image to digital signals, and the converted digital signals are transmitted to the application processor 233 or the memory controller 232. Under the control of the application processor 233, the converted digital signals may be displayed through the display device 235, or may be stored in the memory device 231 through the memory controller 232.

In addition, the data stored in the memory device 231 may be displayed on the display device 235 under the control of the application processor 233 or the memory controller 232.

In an exemplary embodiment of the inventive concept, the memory controller 232 may be implemented as a part of the application processor 233 or as a component located separated from the application processor 233.

As described above, according to exemplary embodiments of the inventive concept, to reduce a crosstalk phenomenon, an LCD device detects crosstalk-causing data pattern data, and performs compensation with a predetermined voltage and a predetermined time to provide a modulated gamma voltage. According to exemplary embodiments, the cost of manufacturing the LCD device may be reduced and the spatial efficiency within the LCD device may be improved (e.g., by using less physical resources, as described above).

As described above, exemplary embodiments of the inventive concept may be utilized in implementing a memory device, and in particular, in implementing an LCD device and a memory system having the same.

While the present inventive concept has been particularly shown and described with reference to the exemplary embodiments thereof, it will be understood by those of ordinary skill in the art that various changes in form and detail may be made therein without departing from the spirit and scope of the present inventive concept as defined by the following claims.

What is claimed is:

1. A liquid crystal display (LCD) device, comprising:

a display comprising a plurality of pixels;

a voltage compensation controller configured to control the plurality of pixels and determine whether to compensate a predetermined grayscale voltage to be applied to the plurality of pixels; and a voltage generator configured to provide the predetermined grayscale voltage to the plurality of pixels in response to the voltage compensation controller determining not to compensate the predetermined grayscale voltage, and to compensate the predetermined grayscale voltage and provide the compensated predetermined grayscale voltage to the plurality of pixels in response to the voltage compensation controller determining to compensate the predetermined grayscale voltage, wherein the voltage compensation controller is configured to determine whether to compensate the predetermined grayscale voltage based on whether crosstalk is detected, the voltage compensation controller is configured to receive image data and compare the image data with a crosstalk-causing data pattern, and the voltage compensation controller is configured to determine whether to compensate the predetermined grayscale voltage based on a comparison result obtained by comparing the image data with crosstalk-causing data pattern.

2. The LCD device of claim 1, wherein the voltage compensation controller comprises:

a timing controller configured to compare the image data with the crosstalk-causing data pattern; and an interface configured to update data relating to compensation of the predetermined grayscale voltage based on the comparison result obtained by comparing the image data with the crosstalk-causing data pattern, and provide the voltage generator with the updated data.

3. The LCD device of claim 2, wherein the interface is configured to generate predetermined time information and predetermined voltage information based on the comparison result obtained by comparing the image data with the cross-talk causing data pattern.

4. The LCD device of claim 1, wherein:

the voltage generator is controlled by the voltage compensation controller, and the voltage generator is configured to compensate a gamma voltage based on the comparison result obtained by comparing the image data with the cross-talk causing data pattern, and provide the compensated predetermined grayscale voltage to the plurality of pixels using the compensated gamma voltage.

5. The LCD device of claim 4, wherein the voltage generator comprises:

a digital gamma voltage generator configured to generate the gamma voltage; and a digital grayscale voltage generator configured to receive the gamma voltage and modulate the gamma voltage using a predetermined time condition and a predetermined voltage condition under control of the voltage compensation controller to provide the compensated predetermined grayscale voltage to the plurality of pixels.

6. The LCD device of claim 1, wherein the voltage generator is configured to compensate the predetermined grayscale voltage without referencing a common voltage applied to the plurality of pixels.

7. A liquid crystal display (LCD) device, comprising:

a timing controller configured to control a display panel, receive image data, and compare the image data with a predetermined crosstalk-causing data pattern to determine whether crosstalk exists;

an interface coupled to the timing controller, and configured to update a data packet to compensate for the predetermined crosstalk-causing data pattern in response to the timing controller determining that the crosstalk exists; and a voltage generator configured to compensate a gamma voltage using the data packet under control of the interface in response to the timing controller determining that the crosstalk exists.

8. The LCD device of claim 7, wherein the timing controller comprises:

a pattern data detector configured to compare the image data with the predetermined crosstalk-causing data pattern; and a lookup table configured to share a plurality of time conditions and a plurality of voltage conditions, each corresponding to one of a plurality of crosstalk-causing data patterns, wherein the predetermined crosstalk-causing data pattern is one of the plurality of crosstalk-causing data patterns.

9. The LCD device of claim 7, wherein the data packet comprises a predetermined time condition and a predetermined voltage condition.

10. The LCD device of claim 7, wherein the voltage generator is configured to adjust the gamma voltage to provide a compensated grayscale voltage to a plurality of pixels of the display panel in response to the timing controller determining that the crosstalk exists.

11. The LCD device of claim 10, wherein the voltage generator comprises:

a digital gamma voltage generator configured to generate a digital reference gamma voltage as the gamma voltage; and a digital grayscale voltage generator configured to provide the compensated grayscale voltage to the plurality of pixels using the digital reference gamma voltage, wherein the voltage generator is configured to modulate the digital reference gamma voltage using a predetermined time condition and a predetermined voltage condition under control of the interface to provide the compensated grayscale voltage to the plurality of pixels.

12. The LCD device of claim 11, wherein the digital gamma voltage generator comprises a plurality of digital gamma buffers.

13. The LCD device of claim 11, wherein the digital grayscale voltage generator comprises:

a resistor string configured to receive the digital reference gamma voltage; and a pre-decoder coupled to the resistor string.

14. The LCD device of claim 13, wherein the digital reference gamma voltage is compensated using the predetermined time condition and the predetermined voltage condition based on the data packet in response to the timing controller determining that the crosstalk exists.

15. The LCD device of claim 13, wherein the pre-decoder is configured to output the compensated grayscale voltage in response to the timing controller determining that the cross-talk exists.

16. The LCD device of claim 7, wherein the voltage generator is configured to compensate the gamma voltage without referencing a common voltage applied to a plurality of pixels.

17. A method of driving a liquid crystal display (LCD) device, comprising:

receiving image data at the LCD device;

comparing the image data with a preset crosstalk-causing data pattern, wherein the preset crosstalk-causing data pattern corresponds to a data pattern predetermined to cause crosstalk;

determining whether to compensate a predetermined grayscale voltage to be applied to a plurality of pixels of the LCD device based on a comparison result obtained by comparing the image data with the preset crosstalk-causing data pattern;

compensating the predetermined grayscale voltage and applying the compensated predetermined grayscale voltage to the plurality of pixels when the comparison result indicates that the image data and the preset crosstalk-causing data pattern match; and applying the predetermined grayscale voltage to the plurality of pixels without compensation when the comparison result indicates that the image data and the preset crosstalk-causing data pattern do not match.

18. The method of claim 17, wherein compensating the predetermined grayscale voltage is performed without referencing a common voltage applied to the plurality of pixels.

19. The method of claim 17, wherein the preset crosstalk-causing data pattern is one of a plurality of preset crosstalk-causing data patterns, and comparing the image data comprises comparing the image data to each of the plurality of preset crosstalk-causing data patterns.

* * * * *